United States Patent [19]

Nishino

[11] 3,969,720

[45] July 13, 1976

[54] EMERGENCY ALARM AND EVACUATION SYSTEM

[76] Inventor: Shiro Nishino, No. 462, Nakakosaka, Higashiosaka, Osaka, Japan

[22] Filed: July 18, 1975

[21] Appl. No.: 597,208

[30] Foreign Application Priority Data

July 26, 1974 Japan ..... 49-86322

[52] U.S. Cl. ..... 340/371; 340/332; 340/326; 340/309.4

[51] Int. Cl.[2] ..... G08B 7/00

[58] Field of Search ..... 340/371, 227.1, 378, 340/326, 332, 309.4

[56] References Cited

UNITED STATES PATENTS 3,916,404 10/1975 Gouge ..... 340/371

*Primary Examiner*—Harold I. Pitts

*Attorney, Agent, or Firm*—Leydig, Voit, Osann, Mayer & Holt, Ltd.

[57] ABSTRACT

An emergency alarm and evacuation system for directing persons to an emergency exit. The system includes an alarm, a plurality of indicator units arranged in a line toward the emergency exit, and an operating unit coupled to the alarm and being operable in response to an output signal from the alarm to successively energize the indicator units in the direction of the exit. The indicator units each have a light and a buzzer so as to generate both an audible and visual indication at a common point whereby persons may be guided by the sounds, the visual indications, or both, depending upon the smoke or noise conditions.

9 Claims, 6 Drawing Figures

EMERGENCY ALARM AND EVACUATION SYSTEM

DESCRIPTION OF THE INVENTION

The present invention relates to emergency alarm and evacuation systems.

It is an object of the present invention to provide an emergency alarm and evacuation system which is activated automatically upon actuation of a conventional fire alarm and which provides timed audible and visual indications at successive common points, which if followed will lead persons to the emergency exit.

Another object is to provide an emergency alarm and evacuation system as characterized above which includes a control mechanism for periodically repeating the successive activation of said visual and audible indicators once the fire alarm is activated.

A further object is to provide an emergency alarm and evacuation system of the above kind in which each indicator includes a lamp and buzzer that are activated simultaneously whereby persons may be led to an emergency exit by the sound, light, or both, depending upon the smoke or noise conditions existing.

BRIEF DESCRIPTION OF THE DRAWINGS

Other objects and advantages of the invention will become apparent upon reading the following detailed description and upon reference to the drawings, in which.

Figure 1:
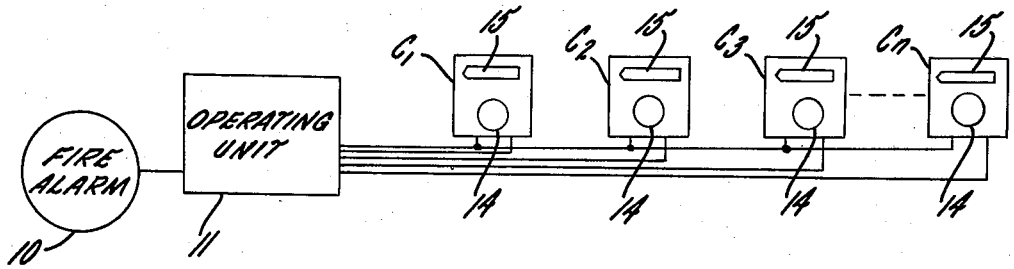
FIG. 1 is a block diagram of an emergency alarm and evacuation system according to the present invention.

While the invention is susceptible of various modifications and alternative constructions, certain illustrative embodiments have been shown in the drawings and will be described below in detail. It should be understood, however, that there is no intention to limit the invention to the specific form disclosed, but, on the contrary, the intention is to cover all modifications, alternative constructions, and equivalents falling within the spirit and scope of the invention.

DESCRIPTION OF THE PREFERRED EMBODIMENT

Referring now more particularly to FIG. 1 of the drawings, there is diagrammatically illustrated an emergency alarm and evacuation system embodying the present invention. The system includes a fire alarm 10 coupled to an operating unit 11 which in turn is adapted to control the actuation of a plurality of indicator units (C1, C2, C3 . . . Cn) provided at regular intervals leading to an emergency exit. The fire alarm 10 may be of a known type, such as an emergency bell, which when actuated is adapted to sound the bell and also produce an electrical output signal. The indicator units (C1, C2, C3 . . . Cn) in this case each include an electrically operated buzzer 14 and a pilot lamp 15 in a separate closed circuit so that when the circuit of each unit is energized the indicator unit gives both a visual and audible indication.

In accordance with the invention, in response to a signal from the alarm, the operating unit will successively and repeatedly activate the indicator units, causing each unit to successively generate an audible and visual indication at a common point whereby persons may be guided or directed to the emergency exit by the sound, the visual indication, or both, depending upon the smoke or noise conditions. To this end, the operating unit 11 includes a power circuit 20 and an operating circuit 21, with the power circuit 20 being adapted to supply power to the operating circuit 21 in response to a signal from the alarm 10.

Figure 2:
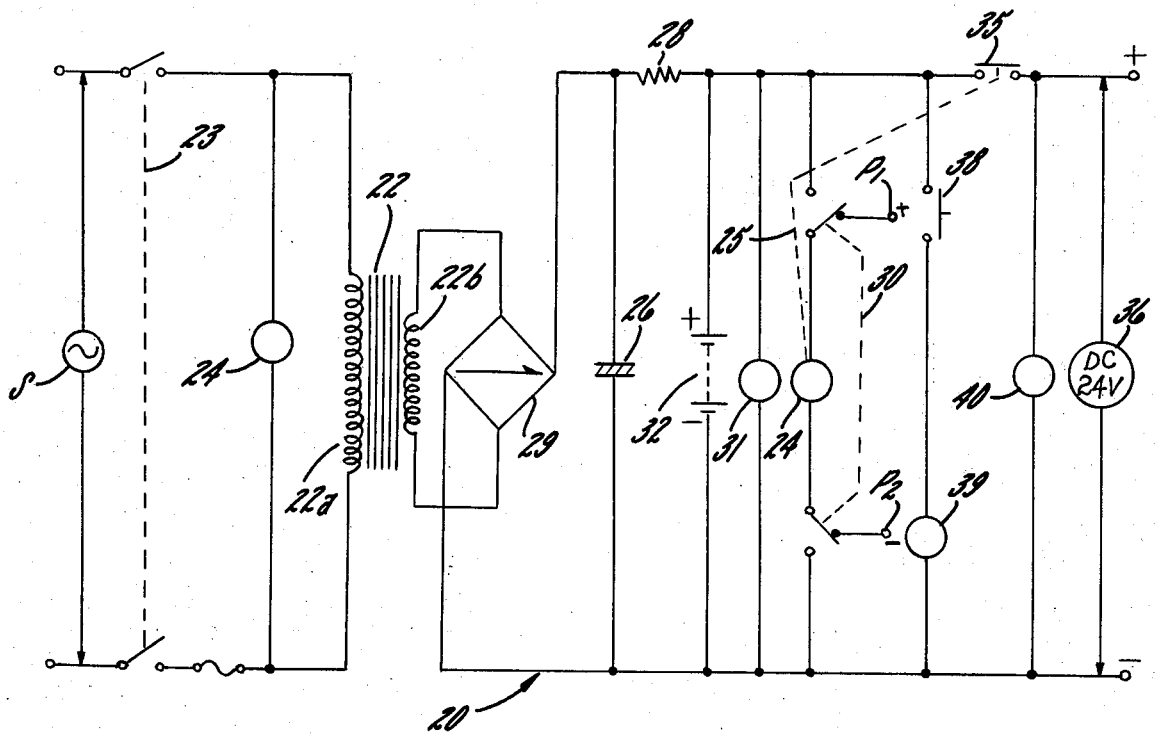
FIG. 2 is a circuit diagram of the power circuit of the operating unit utilized in the system shown in FIG. 1.

Referring to FIG. 2, the power circuit 20 includes a power supply S, such as a 100 volt power supply, that is connected to a high tension winding 22*a* of a power transformer 22 through a power switch 23. A pilot lamp 24, which is adapted to flash when connected to the power supply S, is coupled across the high tension winding 22*a* of the transformer. The transformer 22 has a low tension winding 22*b* that can be connected to an exciting coil 24 of a self-holding relay 25 through a smoothing circuit consisting of a capacitor 26, a resistor 28, and a full-wave rectifier 29. To connect the exciting coil 24 to the power transformer 22 for testing the circuit, a pushbutton switch 20 is provided. A volt meter 31, as well as the exciting coil 24 when the switch 30 is depressed, are connected across a DC circuit comprising said smoothing circuit and a DC power supply 32.

In carrying out the invention, an output signal resulting from actuation of the fire alarm 10 is directed to normally closed contacts P1, P2, of the pushbutton switch 30 which causes a current in the exciting coil 24 of the self-holding relay 25 and thereby closes an output contact 35. In the illustrated embodiment, a DC low-voltage power supply 36, such as 24 volts, is connected to the DC circuit consisting of the smoothing circuit and the DC power supply 32 through the output contact 35. A series circuit consisting of a pushbutton switch 38 and relay 39 is connected across the smoothing circuit and a pilot lamp 40 is coupled to the input terminals of the DC low voltage power supply 36.

Figure 3:
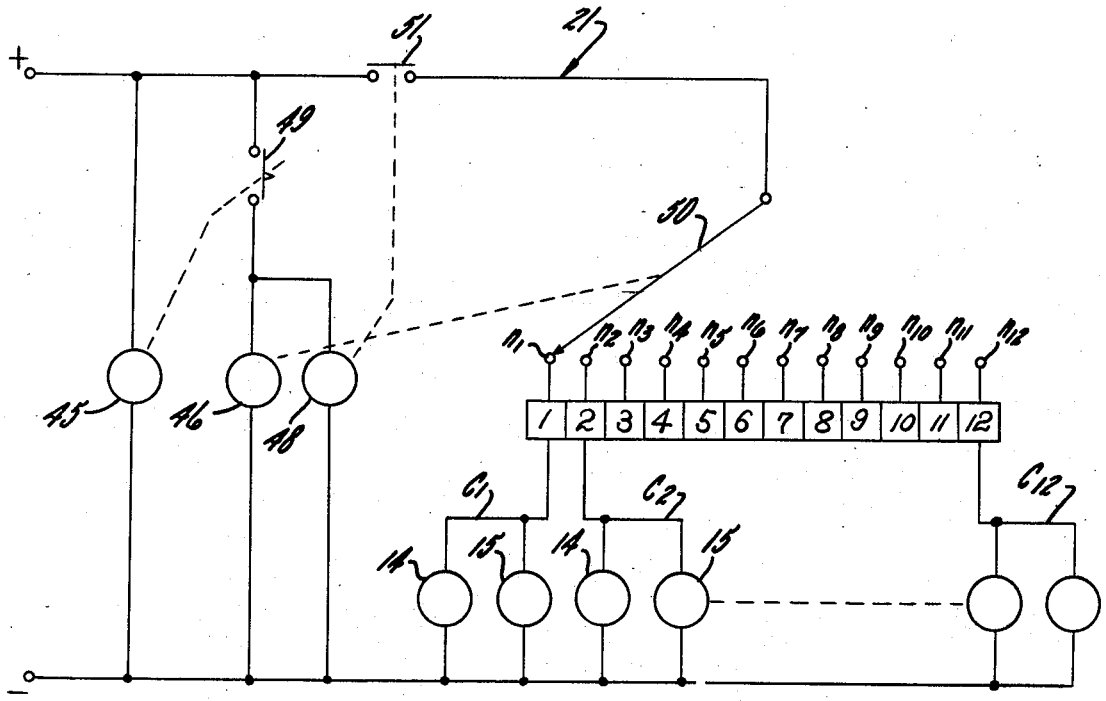
FIG. 3 is a circuit diagram of the operating circuit of the operating unit utilized in the system shown in FIG. 2.

Referring now to FIG. 3, there is shown the operating circuit 21 for activating the indicator units (C1, C2, C3 . . . Cn) in response to closing of the relay contact 35. The operating circuit 21 includes a timer 45 of a known type that is coupled to the terminals of the DC low voltage power supply 36 and will upon actuation repeatedly move between on-off positions at a determined relatively high frequency. A parallel circuit consisting of a count relay 46 and an ordinal relay 48 is connected in series with an output contact 49 of the timer 45. The count relay 46 has a changeover contact piece 50 that is connected through an output contact 51 of the ordinal relay 48 so that it can be moved successively into contact with a plurality of contacts (*n*1, *n*2, *n*3 . . . *n*12) of a rotary switch. Each one of the indicator units (C1, C2, C3 . . . C12) has its closed circuit, comprising the pilot lamp 15 and buzzer 14, connected to one of the contacts (*n*1, *n*2, *n*3 . . . *n*12) so that as the respective contact for each indicator unit is closed the buzzer and lamp are simultaneously energized.

In operation of the illustrated system, when the fire alarm 10 is activated the electrical output signal therefrom is directed to the contacts P1, P2 in the power circuit 20. The self-holding relay 25 detects the signal, whereupon the exciting current in the coil 24 closes the contact 35. Upon closing of the contact 35, the timer 45 is actuated and its output contact 49 makes repeated on-off actions at a predetermined relatively high frequency interval. Such actuation of the timer contact 49 in turn causes the count relay 49 and ordinal relay 48 to repeat the on-off action and the changeover contact piece 50 is moved successively into contact with contacts (*n*1, *n*2, *n*3 . . . *n*12) of the rotary switch. As a result, the closed circuits of the indicator units (C1, C2, C3 . . . Cn) are successively energized causing a simultaneous sounding of the buzzer and illumination of the lamp of the respective unit during the time its contact is closed.

Figure 6:
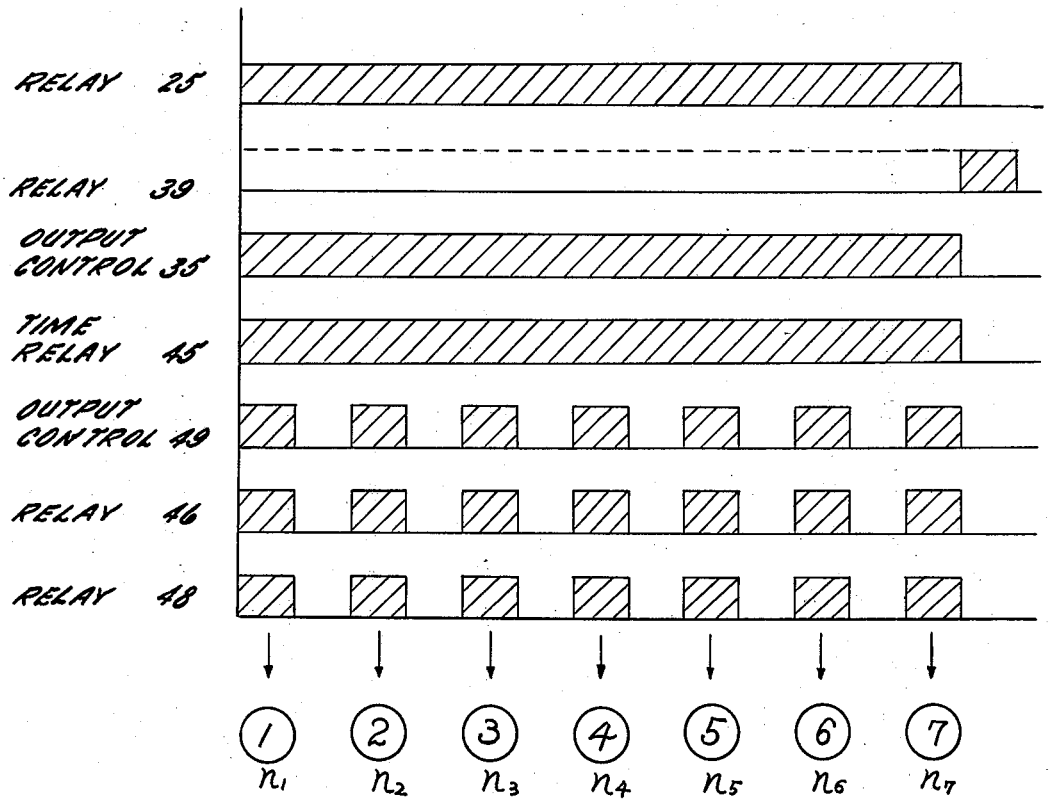
FIG. 6 is a time chart showing the conditions of actuation of the operating circuit shown in FIG. 3.

A time chart showing the operation of the power and operating circuits is illustrated in FIG. 6. It can be seen that once the relay 25 is activated its contact 35 is closed and the relay 39 deactivated. Closure of the contact 35 allows the timer 45 to be activated causing successive on-off actions of its output contact 49 which in turn effects on-off actions of the relays 46 and 48 causing the changeover contact piece 50 to successively engage the contacts (*n*1, *n*2, *n*3 . . . *n*12) for relatively short periods. It will be seen that since the successive indicator units are flashed and sounded in a direction toward the emergency exit persons may be led by either the visual or audible indication depending on the smoke and noise conditions.

Figure 4:
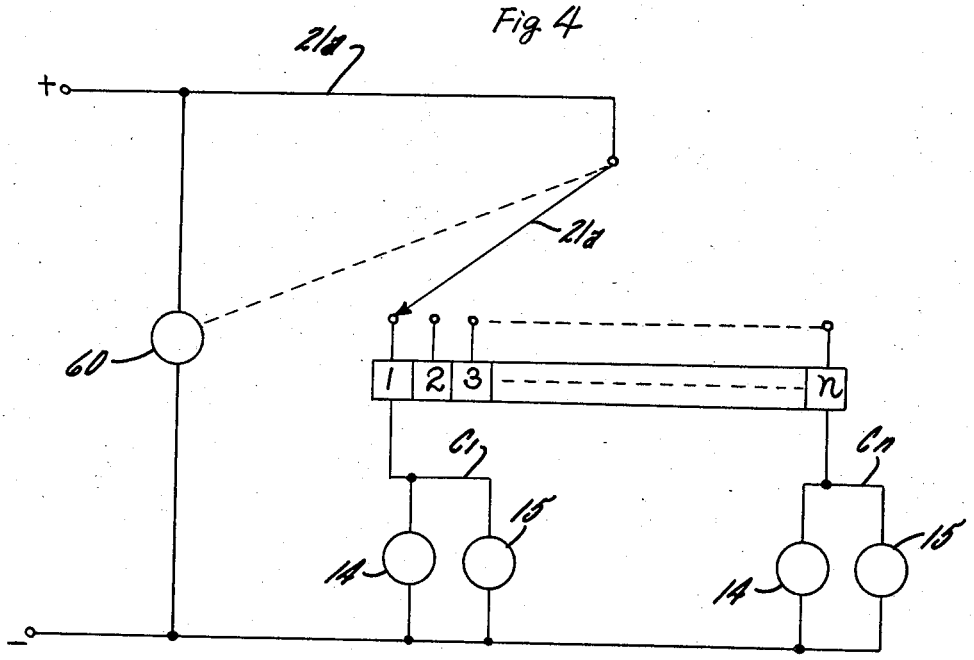
FIG. 4 is a modified form of operating circuit.

Referring now to FIG. 4, there is shown a modified form of operating circuit 21*a* for the operating unit 11. The circuit 21*a* in this case includes a reduction motor 60 connected across the output terminals of the power circuit 20 previously described so as to be energized upon activation of the self-holding relay 25. The motor 60 is coupled to and adapted to drive the contact piece 21*a* of a rotary switch for successively closing the contacts (*n*1, *n*2, *n*3 . . . *n*12) of the rotary switch which in turn will energize successive indicator units (C1, C2, C3 . . . C12). It will be seen that in this case the speed at which the indicator units are successively energized can be varied by varying the operating speed of the motor 60.

Figure 5:
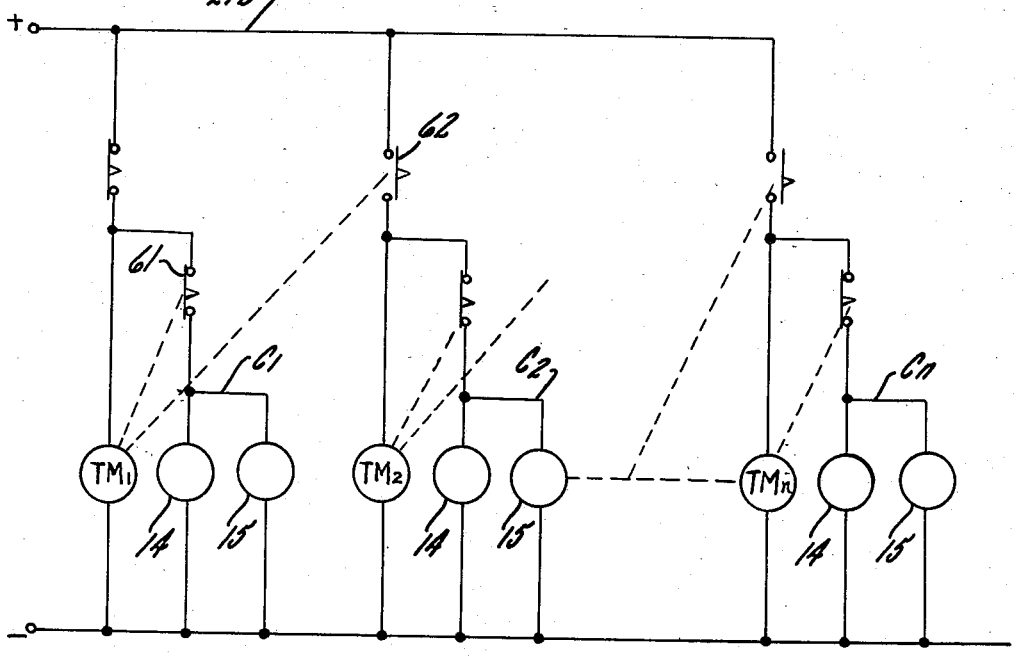
FIG. 5 is still another alternative form of operating circuit.

FIG. 5 shows still another form of operating circuit 21*b* which includes a plurality of parallel delay timers (TM1, TM2, TM3 . . . TM*n*) corresponding to the number of indicator units. Again the operating circuit 21*b* is coupled to the power circuit and is activated upon closure of the contact 24 of the self-holding relay 25. The illustrated timers each are adapted to close a contact 61 which permits energization of the associated indicator unit, as well as contact 62 that couples the timer for the succeeding timer to the power source. Thus, the pilot lamps 15 and buzzers 14 of each indicator unit (C1, C2, C3 . . . C*n*) are successively flashed and sounded following the delay action of the respective delay timer (TM1, TM2, TM3 . . . TM12), the delay action being predeterminedly set for the desired interval.

From the foregoing, it can be seen that the emergency alarm and evacuation system of the present invention provides an efficient means for leading and directing persons to an emergency exit, even under adverse conditions of smoke or fire. Upon actuation of a fire alarm, the operating units are immediately energized in succession so that light and sound are produced at the same time at predeterminedly fixed time intervals in such manner as to lead persons in the direction of the exit. Since the indicator units each have a pilot lamp and buzzer, persons can find their way even when the direction-showing pilot lamps cannot be seen due to smoke.

I claim as my invention:

1. An emergency alarm and evacuation system for indicating the direction and location of an emergency exit comprising an alarm which when activated produces an electrical output signal, a plurality of indicator units arranged in a line toward said emergency exit, said indicator units each including electrically operated means for generating an audible and visual indication upon being energized, and an operating unit coupled to said alarm and being operable in response to an output signal from said alarm to successively energize said indicator units to produce a simultaneous visual and audible indication at each unit which if followed lead to said exit.

2. The emergency alarm and evacuation system of claim 1 in which said operating unit includes a power circuit and an operating circuit, and means electrically coupling said power circuit to said operating circuit in response to a signal from said alarm.

3. The emergency alarm and evacuation system of claim 2 in which said coupling means includes a self-holding relay with a normally open contact in a line connecting said power circuit to said operating circuit, said self-holding relay being energized in response to an output signal from said alarm to close said contact and thereby electrically connect said power circuit to said operating circuit.

4. The emergency alarm and evacuation system of claim 3 in which each of said indicator units each have a lamp and buzzer in a separate closed circuit, and said operating circuit includes changeover means for successively energizing the circuit of each indicator unit.

5. The emergency alarm and evacuation system of claim 4 in which said changeover means is a changeover contact piece of a count relay, and means for causing said changeover contact piece to be moved to electrically couple successive indicator unit circuits to said power circuit.

6. The emergency alarm and evacuation system of claim 5 in which said means for moving said count relay changeover contact pieces includes a timer relay having an output contact that successively moves between on and off positions to interrupt current flow to said count relay.

7. The emergency alarm and evacuation system of claim 6 in which said operating circuit includes a rotary switch having a plurality of contacts, said indicator units each having a closed circuit connected to one of said rotary switch contacts, and said count relay changeover contact piece being movable to successively close said rotary switch contacts.

8. The emergency alarm and evacuation system of claim 4 in which said operating circuit includes an induction motor coupled to said power circuit and being energized upon energization of said self-holding relay for moving said changeover means to successively energize said indicator units.

9. The emergency alarm and evacuation system of claim 4 in which said operating circuit includes a delay timer associated with each said operating unit circuit, said delay timers each being operable to delay the energization of its respective indicator unit circuit upon energization of said self-holding relay.

* * * * *